US006905119B2

(12) United States Patent
Guddanti et al.

(10) Patent No.: US 6,905,119 B2
(45) Date of Patent: Jun. 14, 2005

(54) PRESSURIZED ROLLER

(75) Inventors: Srinivas Guddanti, Boise, ID (US); Chet Butikofer, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 36 days.

(21) Appl. No.: 10/177,611

(22) Filed: Jun. 19, 2002

(65) Prior Publication Data

US 2003/0234484 A1 Dec. 25, 2003

(51) Int. Cl.[7] ..... B65H 3/06
(52) U.S. Cl. ..... 271/109
(58) Field of Search ..... 271/109, 272, 271/275; 492/4

(56) References Cited

U.S. PATENT DOCUMENTS

| | | | | | |
|---|---|---|---|---|---|
| 1,058,749 | A | * | 4/1913 | Holder | 492/4 |
| 1,067,607 | A | * | 7/1913 | Holder | 492/4 |
| 1,277,995 | A | * | 9/1918 | Musket | 492/4 |
| 1,314,342 | A | * | 8/1919 | Lawrence | 492/4 |
| 1,365,606 | A | * | 1/1921 | Seymour-Jones | 492/4 |
| 2,970,339 | A | * | 2/1961 | Hausman | 425/368 |
| 3,077,293 | A | * | 2/1963 | Watkins | 226/186 |
| 3,166,013 | A | * | 1/1965 | Wyllie et al. | 101/378 |
| 3,253,323 | A | * | 5/1966 | Hans et al. | 492/4 |
| 3,378,902 | A | * | 4/1968 | Hoexter | 492/4 |
| 3,383,884 | A | * | 5/1968 | Meyer | 68/256 |
| 3,574,912 | A | * | 4/1971 | Kraft | 492/4 |
| 3,699,621 | A | * | 10/1972 | Clarke et al. | 492/4 |
| 3,705,449 | A | * | 12/1972 | Kuesters | 492/5 |
| 3,707,749 | A | * | 1/1973 | Henley | 492/5 |
| 4,135,677 | A | * | 1/1979 | Warczak | 242/571.1 |
| 4,150,622 | A | * | 4/1979 | Stollenwerk et al. | 101/378 |
| 4,217,821 | A | * | 8/1980 | Vertegaal et al. | 101/181 |
| 4,360,108 | A | * | 11/1982 | Logothetis | 209/598 |
| 4,381,709 | A | * | 5/1983 | Katz | 101/375 |
| 4,407,199 | A | * | 10/1983 | Moss | 101/375 |
| 4,553,296 | A | * | 11/1985 | Eibe | 492/4 |
| 4,557,028 | A | * | 12/1985 | Eibe | 492/1 |
| 4,580,395 | A | * | 4/1986 | Castoldi | 56/16.4 B |
| 4,903,597 | A | * | 2/1990 | Hoage et al. | 101/401.1 |
| 5,058,497 | A | * | 10/1991 | Bishop et al. | 100/155 R |
| 5,484,370 | A | * | 1/1996 | Jenke et al. | 492/4 |
| 5,507,228 | A | * | 4/1996 | Schulz | 101/375 |
| 5,634,606 | A | * | 6/1997 | Roder | 242/555.3 |
| 5,800,324 | A | * | 9/1998 | Schiel | 492/7 |
| 5,840,386 | A | * | 11/1998 | Hatch et al. | 428/36.9 |
| 6,378,434 | B1 | * | 4/2002 | Gasparrini et al. | 101/483 |

FOREIGN PATENT DOCUMENTS

| | | | | |
|---|---|---|---|---|
| EP | 196443 | A2 | * 10/1986 | B41F/13/10 |
| JP | 61155154 | A | * 7/1986 | B65H/27/00 |
| JP | 03259843 | A | * 11/1991 | B65H/5/06 |

* cited by examiner

*Primary Examiner*—Donald P. Walsh
*Assistant Examiner*—Matthew J. Kohner

(57) ABSTRACT

A roller for use in an imaging system includes a variable hardness, fluid-pressurizable roller core, and a roller cover surrounding the roller core. A source of pressurized fluid can be used to pressurize the roller core to a fixed, predetermined pressure prior to installation of the roller core in an imaging system. Alternatively, a variable-pressure source of pressurized air can be used to variably pressurize the roller core during operation of the imaging system.

17 Claims, 1 Drawing Sheet

PRESSURIZED ROLLER

FIELD OF THE INVENTION

The invention relates generally to rollers for transporting sheet materials.

BACKGROUND OF THE INVENTION

Imaging systems such as printers, fax machines, and copiers are virtually omnipresent, and can be found in homes and offices worldwide. The development of such systems has facilitated improvements in communications that have in turn fostered profound changes in the ways that people live and work. Telecommuting, "virtual" offices, and intra-office networks represent but a few examples of the advancements that have been made possible by modern imaging systems.

Most imaging systems use transport mechanisms to move sheets of imaging material through the system. Typical of such arrangements are those using "nip rollers", in which cylindrical rollers are mounted parallel to one another for rotation in opposite directions. Sheet material is gripped by the rollers in the space between the rollers, the "nip", where rotation or the rollers causes movement of the sheet. The efficacy and reliability of material transport depends upon a variety of factors, among which are roller surface hardness and "nip spacing", i.e., the amount of space between the roller surfaces. Optimal roller surface hardness and nip spacing varies with characteristics of the sheet material passing through the system, including sheet thickness and surface characteristics.

Known systems have taken a variety of approaches to nip roller enhancements. For example, U.S. Pat. No. 5,967,512 to Irsik is directed to a nip roller assembly for adjusting the vertical movement of a top nip roller with respect to a bottom nip roller mounted on a machine base, the assembly including a frame attached to the base, the frame including opposing upwardly extending guide legs and a datum member attached to each guide leg and extending therebetween. A support assembly is adjustably mounted on the frame. The support assembly includes a hanger member extending between the guide legs and moveably engaged with each guide leg, a pilot member attached to the hanger member and selectively adjustably attached to the datum member, a cylinder attached to the hanger member, the cylinder having a plunger which is selectively expandable and retractable from the cylinder, and a nip roller bracket for rotatably supporting the nip roller, the bracket being attached to the plunger and extending between the upright guide rods. The bracket movably engages each guide rod to allow movement of the nip roller bracket in conjunction with the rod.

U.S. Pat. No. 6,286,741 to Itoh shows a method of feeding a photosensitive material processing device, includes providing a pair of feed rollers, each in a form of a coaxially-shaped two-layer structure formed by two-layers extrusion molding using thermoplastic resin, wherein the two-layer structure of each of the feed rollers has an internal layer portion and an external layer portion wherein the modulus of elasticity of either the thermoplastic resin constituting the external layer portion or the thermoplastic resin constituting the internal layer portion of the two-layer structure is 240 kgf/mm.sup.2 or more, the modulus of elasticity of the thermoplastic resin constituting the other layer portion is 900 kgf/mm.sup.2 or more, and the external diameter of one of the feed rollers is 13.7 mm or more. The feed rollers are rotatably supported on a processing rack inside a processing tank of the device so that the rollers oppose one another, with a predetermined clearance, and the photosensitive material is directed between the feed rollers, while rotating at least one of the rollers, to convey the photosensitive material inside the processing tank.

Published U.S. patent application Ser. No. 2001/0022428 to Hebert deals with a method and apparatus for holding recording media against a media support surface of an imaging system using an arrangement of variable cross-section vacuum grooves. Each vacuum groove has a continuously decreasing cross-section along its length. Each vacuum groove has a maximum cross-section adjacent a vacuum port and a minimum cross-section at a distal end of the vacuum groove.

While known rollers attempt to address sheet adhesion and roller force, it can be seen from the foregoing that the need exists for a simple, inexpensive, roller structure that provides adjustability in nip spacing and roller force to accommodate a variety of sheet material types.

SUMMARY OF THE INVENTION

The present invention is directed to a roller for use in an imaging system including a variable hardness, fluid-pressurizable roller core, and a roller cover surrounding the roller core. A source of pressurized fluid can be used to pressurize the roller core.

DETAILED DESCRIPTION OF THE INVENTION

Figure 1:
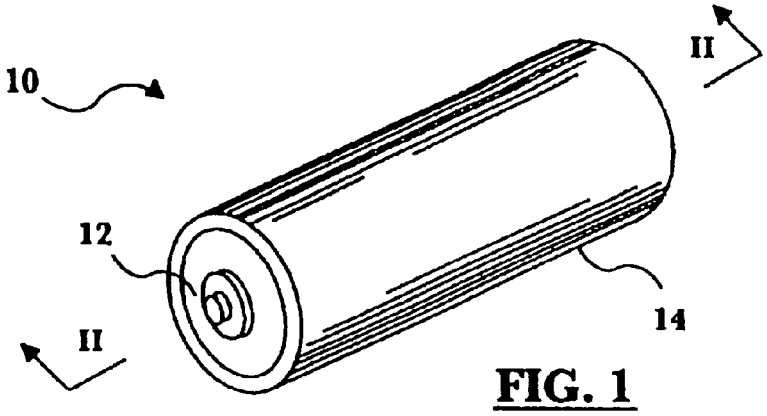
FIG. 1 is a schematic perspective view of an embodiment of a roller in accordance with the principles of the present invention.

An embodiment of a roller 10 in accordance with the principles of the present invention is shown in FIG. 1. The roller 10 includes a roller core 12 surrounded by a roller cover 14. In the illustrated example, both the roller core 12 and the roller cover 14 are substantially annular and cylindrical. The roller cover 14 is constructed from a suitable flexible material, such as foam rubber or plastic. The precise composition of the roller cover material can be selected based upon the desired range of hardnesses for the particular roller application.

Figure 2:
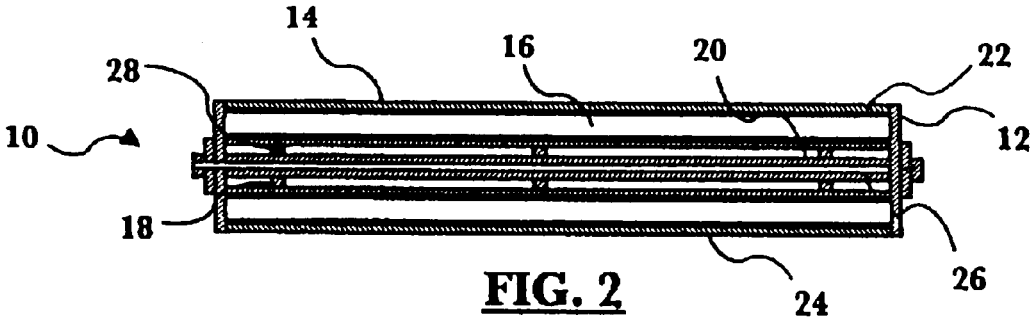
FIG. 2 is a schematic sectional view of the FIG. 1 roller taken generally along lines II—II.

The roller core 12 is adapted and constructed to be fluid-pressurizable. As seen in FIG. 2, the roller core 12 includes a rigid support core 16 supported by a plurality of struts 18 extending from a spindle 20. An annular cylindrical inflatable bladder 22 is positioned between the support core 16 and the roller cover 14. The effective hardness of the outer surface 24 of the roller 10 is determined by the amount of fluid pressure present in the bladder 22, i.e., the effective surface hardness of the roller 10 increases as the pressure in the bladder increases. Pressurized fluid, such as pressurized air, can be introduced into the bladder 22 via an axial conduit 26 in the spindle 20 and a radial conduit 28 in one or more of the struts 18.

Figure 3:
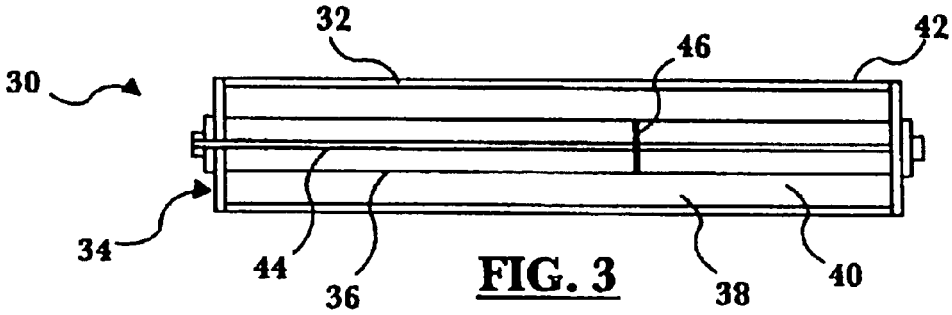
FIG. 3 is a schematic sectional view of an alternative embodiment of a roller in accordance with the principles of the present invention.

An alternative construction of a roller 30 in accordance with the principles of the present invention is illustrated in FIG. 3. The roller 30 includes an annular cylindrical roller cover 32 supported on a roller core 34. As with the roller cover 14 described previously, the roller cover 32 is constructed from a suitable flexible material, such as foam rubber or plastic, and the precise composition of the roller cover material can be selected based upon the desired range of hardnesses for the particular roller application.

The roller core 34 includes a central spindle 36 supported between a pair of disc-shaped roller ends 38. Each end of the roller cover 32 is sealed to a respective roller end 38, forming a pressurizable chamber 40. The effective hardness of the outer surface 42 of the roller 30 is determined by the amount of fluid pressure present in the chamber 40, i.e., the effective surface hardness of the roller 30 increases as the pressure in the chamber increases. Pressurized fluid, such as pressurized air, can be introduced into the chamber 40 via an axial conduit 44 and one or more fluid outlets 46 in the spindle 36.

Figure 4:
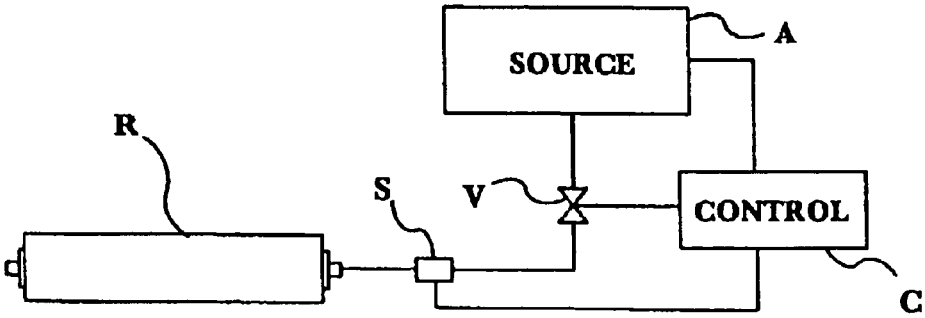
FIG. 4 is a schematic diagram of an embodiment of a roller and pressure source in accordance with the principles of the present invention.

Pressurization of a roller R constructed in accordance with the principles of the present invention is illustrated in FIG. 4. A source of pressurized air A, such as a tank or compressor, is connected to the roller R via a valve V and a pressure sensor S. A control unit C, which can be provided as a microprocessor, is connected to the source of pressurized air A, the roller R, the valve V, and the pressure sensor S. When the amount of pressure to be introduced into the roller R has been determined, the control unit C actuates the air source A and opens the valve V to provide air to the roller R. Once the sensor S indicates that the desired pressure level has been achieved, the control unit C closes the valve V and deactivates the air source A.

The process described with respect to FIG. 4 can be practiced in a variety of ways. For example, if the roller is to be used in an application in which a single effective surface hardness is desired, the control unit can be used to pressurize the roller core of the roller R to a fixed, predetermined pressure. The roller R can then be sealed in a conventional manner and removed from the air source A prior to installation of the roller R in an imaging system. Alternatively, the control unit C, the source of pressurized air A, the roller R, the valve V, and the pressure sensor S can be incorporated into an imaging system, with the control unit C being a part of the imaging system control. In such an arrangement, the source of pressurized air A is essentially a variable-pressure source of pressurized air which can variably pressurize the roller core during operation of the imaging system. This permits the hardness of the roller R to be varied to accommodate a wide variety of imaging media characteristics. Another benefit accrues in the ability of the imaging system control processor to assess how well media is being picked or gripped by the roller. Depending upon the timing of the paper as it is picked, the imaging system can automatically adjust the pressure within the roller with no user interaction for optimal performance.

Although the present invention has been described with reference to specific embodiments, those of skill in the art will recognize that changes may be made thereto without departing from the scope and spirit of the invention as defined by the appended claims.

What is claimed is:

1. A media transport roller for use in an imaging system, the media transport roller comprising:

a fluid-pressurizable, generally cylindrical roller core;

a generally cylindrical roller cover surrounding the roller core, the roller cover including an outer surface for contacting the media during transport, wherein the roller cover is constructed of a flexible material including one of foam rubber and plastic;

a source of pressurized fluid adapted for selective fluid communication with the roller core; and a control mechanism adapted and constructed to selectively vary pressure of the pressurized fluid within the roller core based on characteristics of the media.

2. A media transport roller in accordance with claim 1, wherein the source of pressurized fluid comprises a source of pressurized air adapted and constructed to pressurize the roller core to a fixed, predetermined pressure prior to installation of the roller core in the imaging system.

3. A media transport roller in accordance with claim 1, wherein the pressurized fluid source comprises a variable-pressure source of pressurized air.

4. A media transport roller in accordance with claim 3, wherein the variable-pressure source of pressurized air is connected in fluid communication with the roller core during operation of the imaging system.

5. A media transport roller in accordance with claim 1, wherein the control mechanism is adapted and constructed to selectively vary pressure within the roller core during operation of the imaging system.

6. A media transport roller in accordance with claim 1, wherein the roller core comprises a sealed chamber formed at least in part by the roller cover.

7. A media transport roller for use in an imaging system, the media transport roller comprising:

a variable hardness, fluid-pressurizable roller core; and a roller cover surrounding the roller core, the roller cover including an outer surface for contacting the media during transport, wherein the roller cover is constructed of a flexible material including one of foam rubber and plastic, wherein pressure within the roller core is selectively varied based on characteristics of the media.

8. A media transport roller in accordance with claim 7, further comprising:

a source of pressurized fluid adapted and constructed to pressurize the roller core to a fixed, predetermined pressure prior to installation of the roller core in an imaging system.

9. A media transport roller in accordance with claim 8, wherein the source of pressurized fluid comprises a variable-pressure source of pressurized air.

10. A media transport roller in accordance with claim 7, further comprising:

a source of pressurized fluid adapted and constructed to variably pressurize the roller core during operation of the imaging system.

11. A media transport roller in accordance with claim 7, further comprising:

a control mechanism adapted and constructed to selectively vary pressure within the roller core during operation of the imaging system.

12. A media transport roller in accordance with claim 7, wherein the roller core comprises a sealed chamber formed at least in part by the roller cover.

13. A media transport roller in accordance with claim 7, wherein the roller core and the roller cover are generally cylindrical.

14. A method of determining an effective surface hardness of a media transport roller for use in an imaging system, the method comprising:

gripping a sheet of media with a media transport roller, the media transport roller including a fluid-pressurizable, generally cylindrical roller core and a generally cylindrical roller cover surrounding the roller core, the roller cover including an outer surface for contacting the media during transport, wherein the roller cover is constructed of a flexible material including one of foam rubber and plastic; and supplying fluid under pressure to pressurize the roller core to a level sufficient to bring a surface flexibility of the roller cover to a desired hardness, including selectively varying the hardness of the roller cover based on characteristics of the media.

15. A method in accordance with claim 14, wherein supplying fluid under pressure further comprises supplying pressurized air.

16. A method in accordance with claim 14, wherein supplying fluid under pressure further comprises pressurizing the roller core to a fixed, predetermined pressure prior to installation of the roller core in an imaging system.

17. A method in accordance with claim 14, wherein supplying fluid under pressure further comprises selectively, variably pressurizing the roller core during operation of the imaging system.

* * * * *